US006520350B1

(12) United States Patent
Smith

(10) Patent No.: US 6,520,350 B1
(45) Date of Patent: Feb. 18, 2003

(54) STORAGE SYSTEM

(76) Inventor: Paul R. Smith, 16 Briarwood Ave., Keansburg, NJ (US) 07734

( * ) Notice: Subject to any disclaimer, the term of this patent is extended or adjusted under 35 U.S.C. 154(b) by 0 days.

(21) Appl. No.: 09/815,711

(22) Filed: Mar. 23, 2001

(51) Int. Cl.[7] ..... A47F 5/08; A47G 29/00

(52) U.S. Cl. ..... 211/87.01; 211/85.29; 211/90.01; 211/74; 248/312

(58) Field of Search ..... 211/87.01, 70.6, 211/74, 86.29, 90.01, 94.02; 248/312, 312.1; D7/505, 601, 602, 630, 619, 701

(56) References Cited

U.S. PATENT DOCUMENTS

| | | | | | |
|---|---|---|---|---|---|
| 1,925,540 | A | * | 9/1933 | Neuschotz | 211/74 |
| 2,557,801 | A | | 6/1951 | Shapiro | |
| D176,162 | S | * | 11/1955 | Steece | 211/87.01 |
| 2,816,667 | A | * | 12/1957 | Tanay | 248/312 |
| 2,921,690 | A | * | 1/1960 | Smith et al. | 248/312 |
| 3,001,678 | A | * | 9/1961 | Maxwell | 248/312 |
| 4,019,638 | A | | 4/1977 | Miller | |
| 4,228,905 | A | | 10/1980 | Cammarota | |
| 4,487,135 | A | | 12/1984 | Van Ryn | |
| D312,947 | S | * | 12/1990 | Kopanakis et al. | D6/514 |
| D314,115 | S | * | 1/1991 | Murphy | D6/572 |
| 5,373,953 | A | | 12/1994 | Fenton et al. | |
| D392,142 | S | | 3/1998 | Weisburn et al. | |
| 5,964,359 | A | * | 10/1999 | Marino, Jr. | 211/74 |

* cited by examiner

*Primary Examiner*—Daniel P. Stodola
*Assistant Examiner*—Erica B. Harris

(57) ABSTRACT

A storage system for organizing and storing a multitude of small items in a space efficient manner. The storage system includes a main member having a top face, a bottom face, a front face, a back face and a pair of end faces as well as a plurality of slots extending from the front face towards the back face such that the slots extend substantially parallel to the bottom face; at least one mounting assembly is coupled to the main member such that the main member is designed for mounting to a surface; and a plurality of containers, each designed for storing items and for inserting into one of the slots of the main member such that the containers are supported under the main member.

15 Claims, 5 Drawing Sheets

STORAGE SYSTEM

BACKGROUND OF THE INVENTION

1. Field of the Invention

The present invention relates to storage units and more particularly pertains to a new storage system for organizing and storing a multitude of small items in a space efficient manner.

2. Description of the Prior Art

The use of storage units is known in the prior art. More specifically, storage units heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,019,638; U.S. Pat. No. 5,373,953; U.S. Pat. No. 2,557,801; U.S. Pat. No. 4,228,905; U.S. Pat. No. 4,487,135; and U.S. Pat. No. Des. 392,142.

While these devices fulfill their respective, particular objectives and requirements, the aforementioned patents do not disclose a new storage system. The inventive device includes a main member having a top face, a bottom face, a front face, a back face and a pair of end faces as well as a plurality of slots extending from the front face towards the back face such that the slots extend substantially parallel to the bottom face; at least one mounting assembly is coupled to the main member such that the main member is designed to be mounted to a surface; and a plurality of containers, each designed for storing items and for inserting into one of the slots of the main member such that the containers are supported under the main member.

In these respects, the storage system according to the present invention substantially departs from the conventional concepts and designs of the prior art, and in so doing provides an apparatus primarily developed for the purpose of organizing and storing a multitude of small items in a space efficient manner.

SUMMARY OF THE INVENTION

In view of the foregoing disadvantages inherent in the known types of storage units now present in the prior art, the present invention provides a new storage system construction wherein the same can be utilized for organizing and storing a multitude of small items in a space efficient manner.

The general purpose of the present invention, which will be described subsequently in greater detail, is to provide a new storage system apparatus and method that have many of the advantages of the storage units mentioned heretofore and many novel features that result in a new storage system which is not anticipated, rendered obvious, suggested, or even implied by any of the prior art storage units, either alone or in any combination thereof.

To attain this, the present invention generally comprises a main member having a top face, a bottom face, a front face, a back face and a pair of end faces as well as a plurality of slots extending from the front face towards the back face such that the slots extend substantially parallel to the bottom face; at least one mounting assembly is coupled to the main member such that the main member is designed to be mounted to a surface; and a plurality of containers, each designed for storing items and for inserting into one of the slots of the main member such that the containers are supported under the main member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new storage system apparatus and method that have many of the advantages of the storage units mentioned heretofore and many novel features that result in a new storage system which is not anticipated, rendered obvious, suggested, or even implied by any of the prior art storage units, either alone or in any combination thereof.

It is another object of the present invention to provide a new storage system which may be easily and efficiently manufactured and marketed.

It is a further object of the present invention to provide a new storage system which is of a durable and reliable construction.

An even further object of the present invention is to provide a new storage system that is susceptible of a low cost of manufacture with regard to both materials and labor, and which, accordingly, is then susceptible of low prices of sale to the consuming public, thereby making such storage system economically available to the buying public.

Still yet another object of the present invention is to provide a new storage system which provides in the apparatuses and methods of the prior art some of the advantages thereof, while simultaneously overcoming some of the disadvantages normally associated therewith.

Still another object of the present invention is to provide a new storage system which provides in the apparatuses and methods of the prior art some of the advantages thereof, while simultaneously overcoming some of the disadvantages normally associated therewith.

Still another object of the present invention is to provide a new storage system for organizing and storing a multitude of small items in a space efficient manner.

Yet another object of the present invention is to provide a new storage system that includes a main member having a top face, a bottom face, a front face, a back face and a pair of end faces as well as a plurality of slots extending from the front face towards the back face such that the slots extend substantially parallel to the bottom face; at least one mounting assembly is coupled to the main member such that the main member is designed to be mounted to a surface; and a plurality of containers, each designed for storing items and for inserting into one of the slots of the main member such that the containers are supported under the main member.

Still yet another object of the present invention is to provide a new storage system that can readily be mounted to an existing shelving system.

Even still another object of the present invention is to provide a new storage system that provides visual access to the interior of the storage containers while in the stored position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
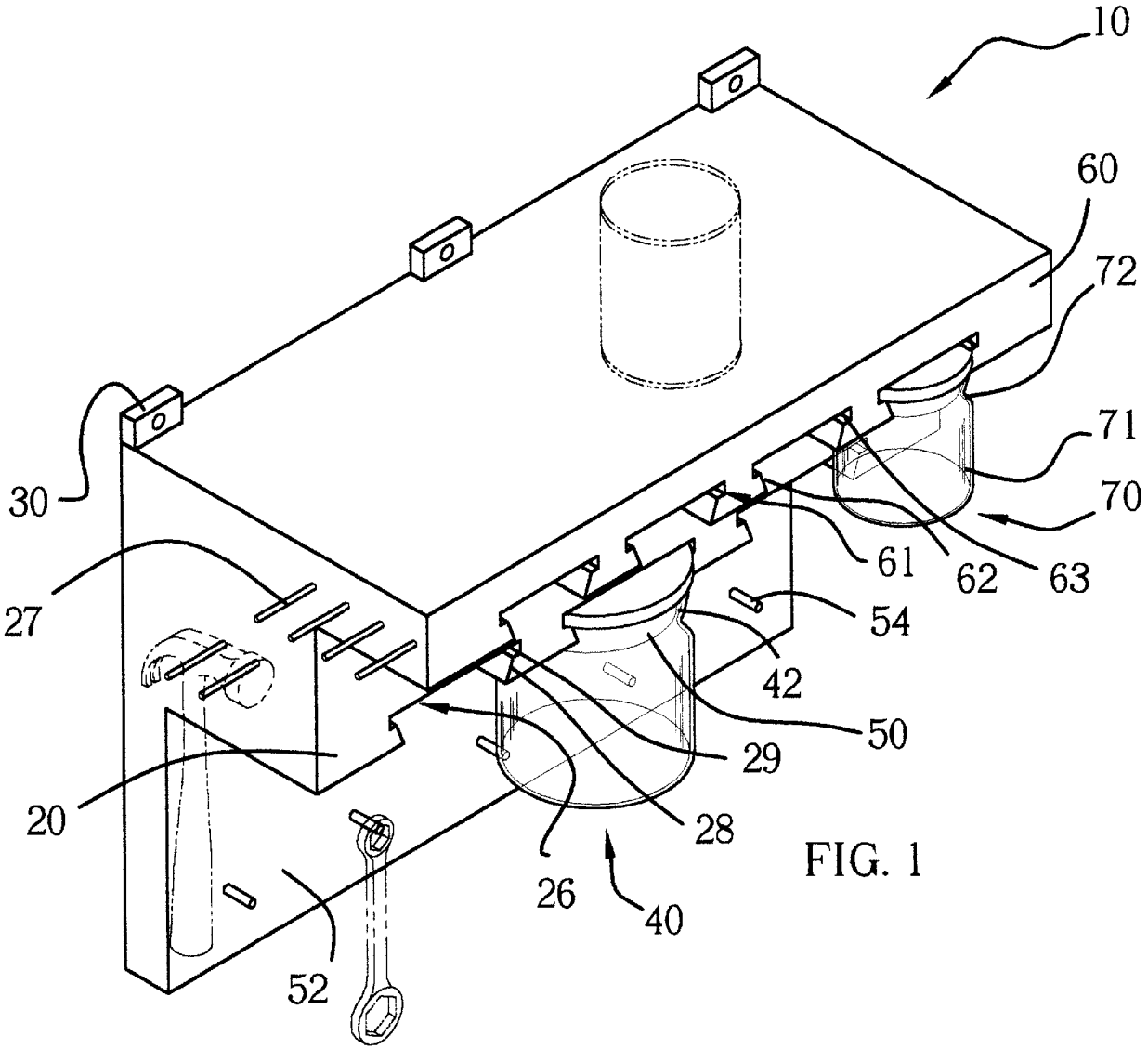
FIG. 1 is a schematic perspective view of a new storage system according to the present invention.

With reference now to the drawings, and in particular to a new storage system embodying the principles and concepts of the present invention and generally designated by the reference numeral 10 will be described.

Figure 2:
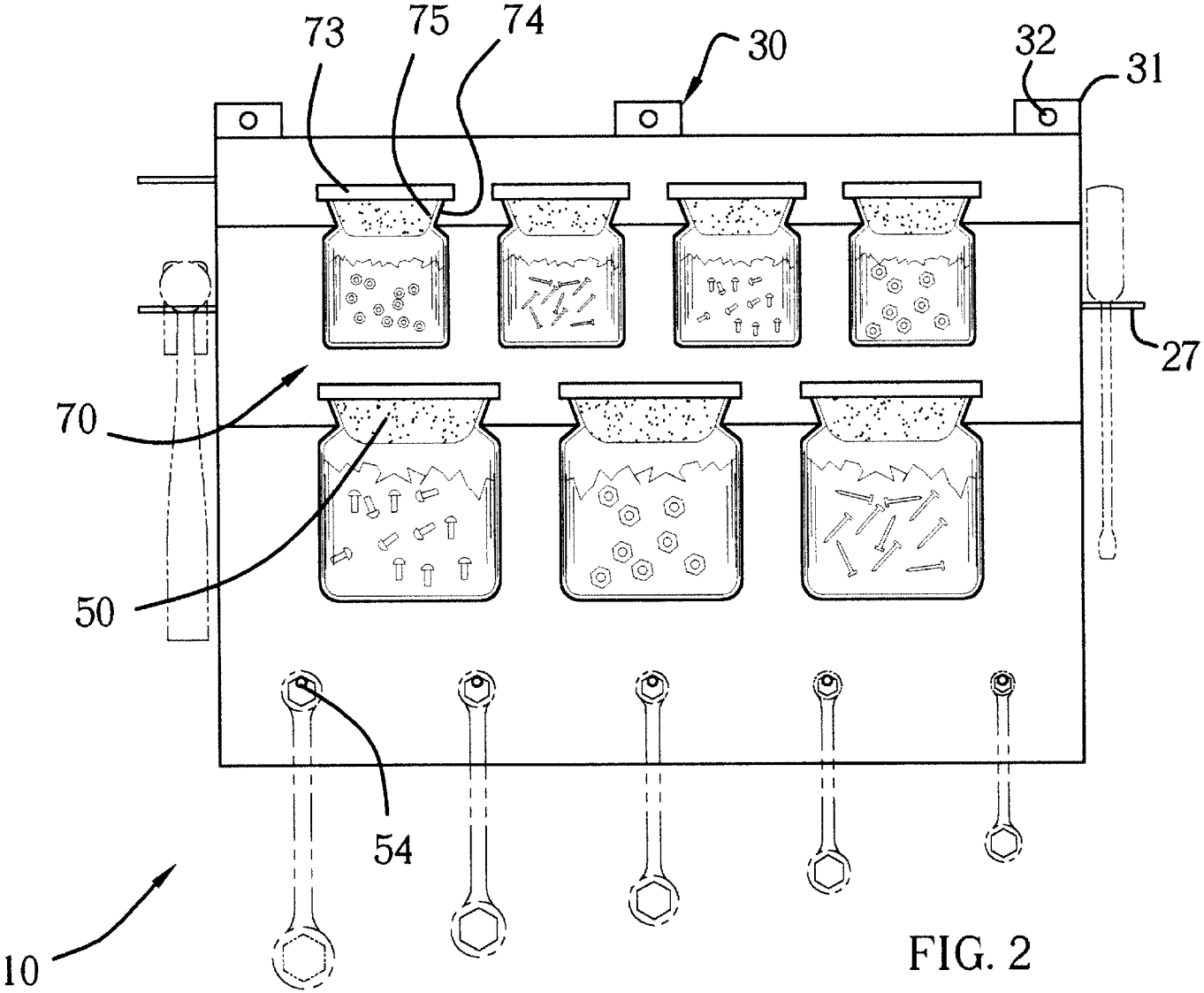
FIG. 2 is a schematic front view of the present invention.
Figure 3:
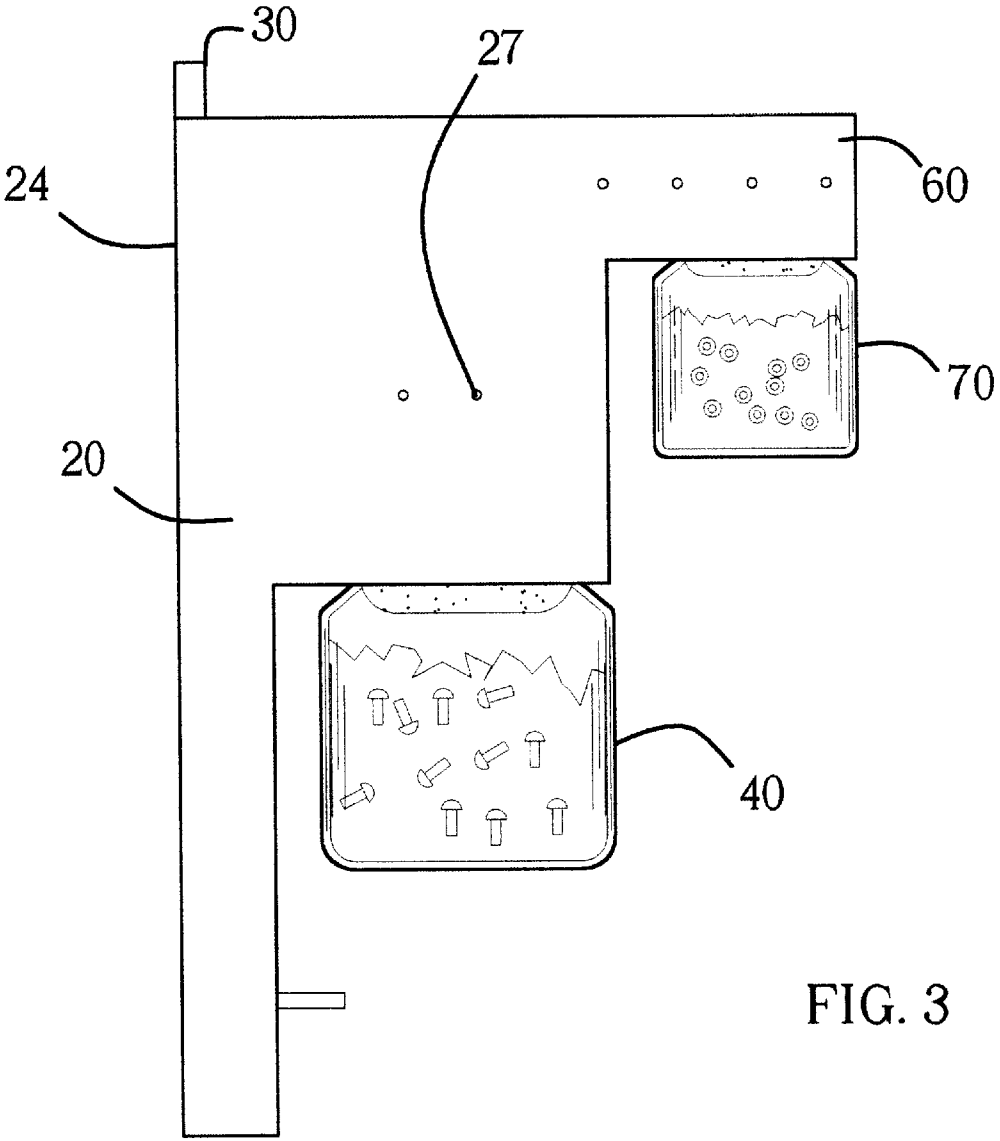
FIG. 3 is a schematic side view of the present invention.
Figure 4:
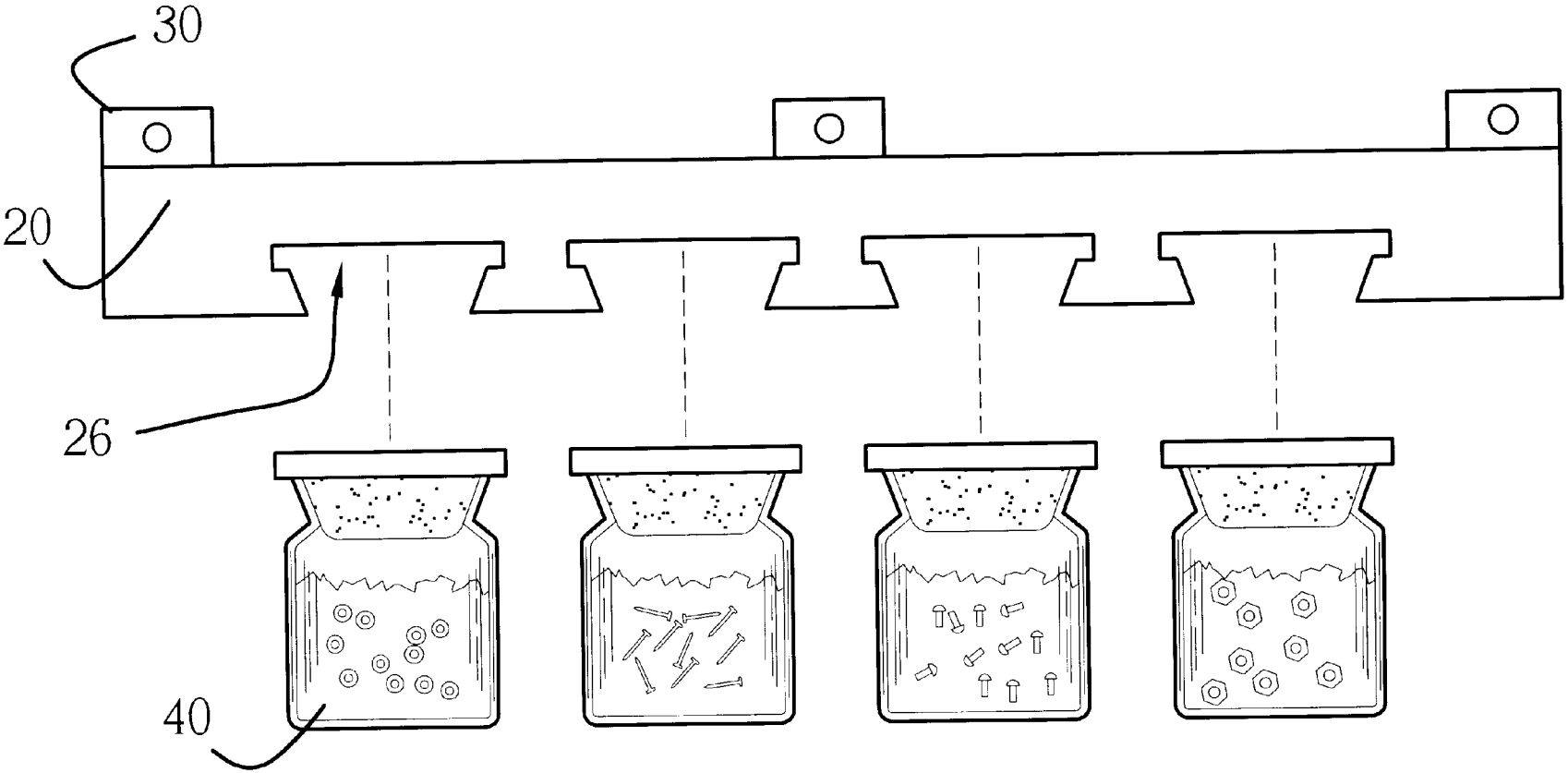
FIG. 4 is a schematic front view of the present invention.
Figure 5:
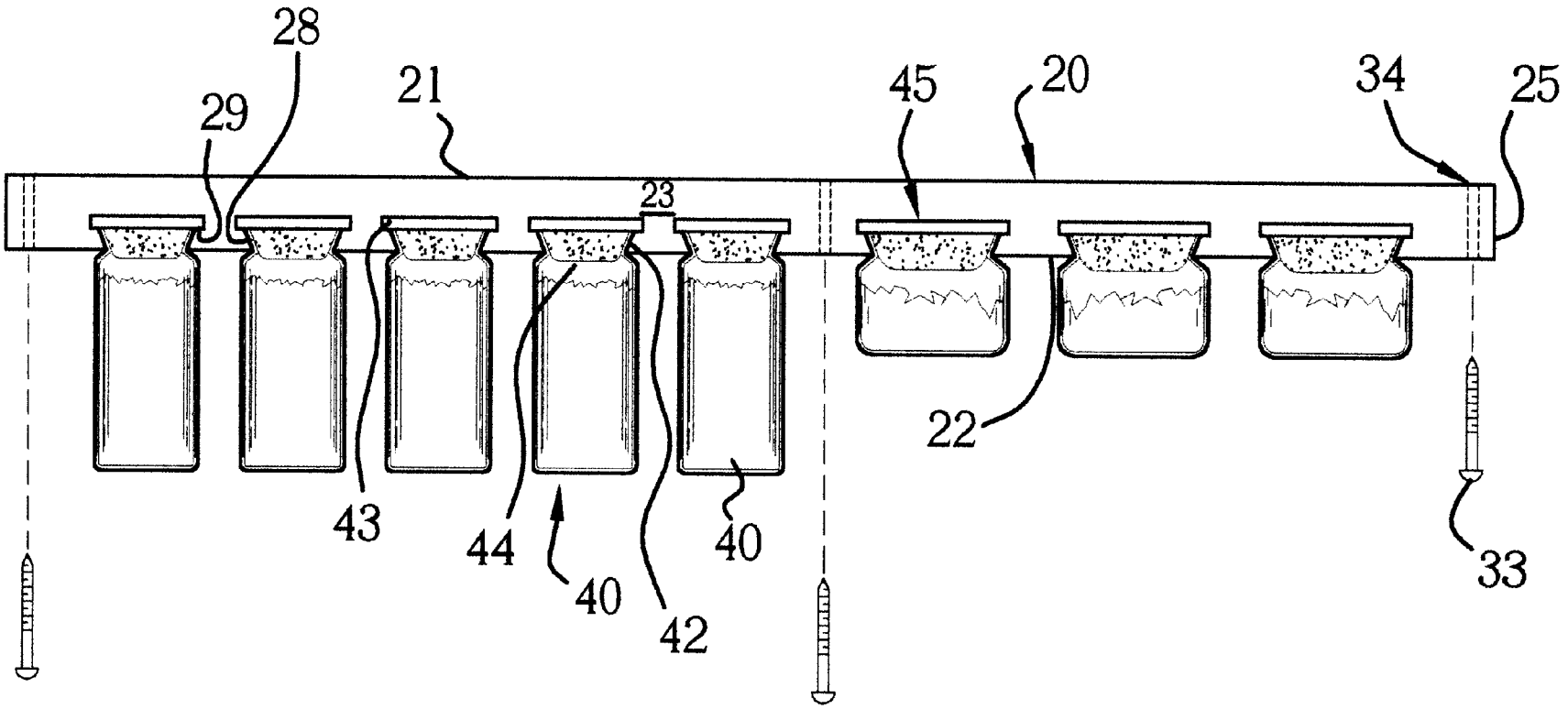
FIG. 5 is a schematic front view of an embodiment of the present invention.

As best illustrated in FIGS. 1 through 5, the storage system 10 generally comprises a main member 20, at least one mounting assembly 30, a plurality of containers 40, a sealing member 50, a secondary member 60, a plurality of second slots 61, a backing wall 52, and a plurality of tool hooks 54.

The main member 20 includes a top face 21, a bottom face 22, a front face 23, a back face 24 and a pair of end faces 25. The main member 20 includes a plurality of slots 26, which extends from the front face 23 towards the back face 24 such that the slots 26 extend substantially parallel to the bottom face 22.

The mounting assembly 30 is coupled to the main member 20 such that the main member 20 is designed for being mounted to a surface.

Each of the plurality of containers 40 is for inserting into one of the slots 26 of the main member 20 such that the containers 40 are supported under the main member 20. Each of the containers 40 is designed for storing items.

In an embodiment at least one of the end faces 25 includes a plurality of tool supports 27 coupled to the respective end face 25. The tool supports 27 are designed for storing tools.

In a further embodiment, each of the mounting assemblies 30 comprises a tab 31. The tab 31 extends upward from the top face of the main member 20. The tab 31 includes an aperture 32 through the tab 31 such that the aperture 32 is for accepting a fastener 33 through the aperture 32. The fastener 33 is designed for insertion into a vertical surface such that the main member 20 is supported by the vertical surface.

In still a further embodiment, the top face 21 of the main member 20 is substantially planar and rectangular such that the top face 21 is designed for setting items on, when the main member 20 is supported by the vertical surface.

In yet a further embodiment, each of the mounting assemblies 30 comprises a mounting aperture 34, which extends vertically through the main member 20 from the bottom face 22 to the top face 21. The mounting aperture 34 is for receiving a fastener 33 such that the fastener 33 is designed for insertion into a horizontal surface through the mounting aperture 34. Thus the main member 20 is supported by the horizontal surface.

In an embodiment, each of the slots 26 has a pair of angled walls 28 and a pair of lip portions 29. Each of the angled walls 28 extends upwardly from the bottom face 22 of the main member 20 such that the angled walls 28 are diverging. Each of the lip portions 29 extends outwardly from a top end of the wall 28 such the each of the lip portions 29 extends parallel to the bottom face 22. Each of the lip portions 29 of the slots 26 is for securing a container 40 within the slot 26.

In still a further embodiment, each of the containers 40 has base portion 41 and an upper portion 42. The upper portion 42 includes a lip 43 for engaging the lip portions 29 of the respective slot 26. The upper portion 42 includes a neck 44, which extends downwardly from the lip 43 of the upper portion 42 such that the neck 44 is for engaging the angled walls 28 of the respective slot 26. Thus the upper portion 42 of the container 40 is insertable within one of the slots 26 of the main member 20.

In an embodiment, each of the containers 40 has an opening 45 which extends through the upper portion 42 into an interior space of the base portion 41 of the respective container 40 such that the interior space is designed for storing items inserted into the opening 45 of the upper portion 42 of the respective container 40.

The sealing member 50 is positionable in the opening 45 of the respective container 40 such that the sealing member 45 prevents the items stored in the container 40 from being spilled.

A secondary member 60 extends orthogonally from the front face 23 of the main member 20 such that the secondary member 60 is positioned adjacent the top face 21 of the main member 20.

The plurality of secondary slots 61 extends through the secondary member 60 such that the slots 61 extend perpendicular to the front face 23 of the main member 20.

In yet a further embodiment, each of the secondary slots 61 has a pair of angled walls 62 and a pair of lip portions 63. Each of the angled walls 62 extends upwardly from a bottom surface of the secondary member 60 such that the angled walls 62 are diverging. Each of the lip portions 63 extends outwardly from a top end of the angled walls 62 such that end of the lip portions 63 extends parallel to the bottom surface. Each of the lip portions 63 of the secondary slots 61 is for securing one of a plurality of receptacles 70 within the secondary slot 61.

In an embodiment, each of the receptacles 70 has a base portion 71 and an upper portion 72. The upper portion 72 includes a lip 73 for engaging the lip portions 63 of the respective secondary slot 61. The upper portion 72 includes a neck 74, which extends downward from the lip 73 of the upper portion 72 such that the neck 74 is for engaging the angled walls 62 of the respective secondary slot 61. Thus the upper portion 72 of the respective receptacle 70 can be inserted within one of the secondary slots 61 of the secondary member 60.

In an embodiment, each of the receptacles 70 has an opening 75, which extends through the upper portion 72 into an interior space of the base portion 71 of the respective receptacle 70 such that the interior space is designed for storing items inserted into the opening 75 of the upper portion 72 of the respective receptacle 70.

The backing wall 52 extends downward from the bottom face 22 of the main member 20 such that the backing wall 52 is positioned adjacent the back face 24 of the main member 20.

The plurality of tool hooks 54 is coupled proximate to a distal end of the backing wall 52 such that the tool hooks 54 are designed for supporting tools.

With respect to the above description then, it is to be realized that the optimum dimensional relationships for the parts of the invention, to includes variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shelf storage system comprising:

a main member having a top face, a bottom face, a front face, a back face and a pair of end faces, said main member having a plurality of slots extending from said front face towards said back face such that said slots extend substantially parallel to said bottom face;

at least one mounting assembly being coupled to said main member such that said main member is adapted for being mounted to a surface;

each of a plurality of containers being for inserting into one of said slots of said main member such that said containers are supported under said main member, each of said containers being adapted for storing items;

a secondary member orthogonally extending from said front face of said main member, said secondary member being positioned adjacent said top face of said main member such that said secondary member is positioned between said slots of said main member and said top face of said main member; and a plurality of secondary slots extending through said secondary member such that said slots extend perpendicular to said front face of said main member, each of said secondary slots selectively receiving one of a plurality of receptacles such that said receptacles are positioned between said slots of said main member for permitting removal of said containers from said slots in said main member when said receptacles are positioned in said secondary slots of said secondary member.

2. The shelf storage system as set forth in claim 1, wherein at least one of said end faces has a plurality of tool supports coupled to said respective end face, said tool supports being adapted for storing tools.

3. The shelf storage system as set forth in claim 1, wherein each said mounting assembly comprises a tab, said tab upwardly extending from said top face of said member, said tab having an aperture through said tab such that said aperture is for accepting a fastener through said aperture, said fastener being adapted for insertion into a vertical surface such that said main member is supported by the vertical surface.

4. The shelf storage system as set forth in claim 3, wherein said top face of said main member is substantially planar rectangular such that said top face is adapted for setting items on when said main member is supported by the vertical surface.

5. The shelf storage system as set forth in claim 1, wherein each said mounting assembly comprises a mounting aperture extending vertically through said main member from said bottom face to said top face, said mounting aperture being for receiving a fastener such that said fastener is adapted for insertion into a horizontal surface through said mounting aperture whereby said main member is supported by the horizontal surface.

6. The shelf storage system as set forth in claim 1, wherein each of said slots has a pair of angled walls and a pair of lip portions, each of said angled walls extends upwardly from said bottom face of said main member such that said angled walls are diverging, each of said lip portions extends outwardly from a top end of said wall such that each of said lip portions extends parallel to said bottom face, each of said lip portions of said slots being for securing a container within said slot.

7. The shelf storage system as set forth in claim 6, wherein each of said containers has base portion and an upper portion, said upper portion having a lip for engaging said lip portions of said respective slot, said upper portion having a neck extending downwardly from said lip of said upper portion such that said neck is for engaging said angled walls of said respective slot whereby said upper portion of said container is insertable within one of said slots of said main member.

8. The shelf storage system as set forth in claim 7, wherein each of said containers has an opening extending through said upper portion into an interior space of said base portion of said respective container such that said interior space is adapted for storing items inserted into said opening of said upper portion of said respective container.

9. The shelf storage system as set forth in claim 8, further comprises:

a sealing member being positionable in said opening of said respective container such that said sealing member prevents the items stored in said container from being spilled.

10. The shelf storage system as set forth in claim 1, wherein each of said secondary slots has a pair of angled walls and a pair of lip portions, each of said angled walls extends upwardly from a bottom surface of said secondary member such that said angled walls are diverging, each of said lip portions extends outwardly form a top end of said angled walls such the each of said lip portions extends parallel to said bottom surface, each of said lip portions of said secondary slots being for securing one of a plurality of said receptacles within said secondary slot.

11. The shelf storage system as set forth in claim 10, wherein each of said receptacles has a base portion and an upper portion, said upper portion having a lip for engaging said lip portions of said respective secondary slot, said upper portion having a neck extending downwardly from said lip of said upper portion such that said neck is for engaging said angled walls of said respective secondary slot whereby said upper portion of said respective receptacle is insertable within one of said secondary slots of said secondary member.

12. The shelf storage system as set forth in claim 11, wherein each of said receptacles has an opening extending through said upper portion into an interior space of said base portion of said respective receptacle such that said interior space is adapted for storing items inserted into said opening of said upper portion of said respective receptacle.

13. The shelf storage system as set forth in claim 12, further comprising:

a sealing member being positionable in said opening of said respective receptacle such that said sealing member prevents the items stored in said receptacle from being spilled.

14. The shelf storage system as set forth in claim 1, further comprising:

a backing wall downwardly extending from said bottom face of said main member such that said backing wall is positioned adjacent said back face of said main member;

a plurality of tool hooks being coupled proximate to a distal end of said backing wall such that said tool hooks are adapted for supporting tools.

15. A shelf storage system comprising:

a main member having a top face, a bottom face, a front face, a back face and a pair of end faces, said main member having a plurality of slots extending from said front face towards said back face such that said slots extend substantially parallel to said bottom face;

at least one mounting assembly being coupled to said main member such that said main member is adapted for being mounted to a surface;

each of a plurality of containers being for inserting into one of said slots of said main member such that said containers are supported under said main member, each of said containers being adapted for storing items;

wherein at least one of said end faces has a plurality of tool supports coupled to said respective end face, said tool supports being adapted for storing tools;

wherein each said mounting assembly comprises a tab, said tab upwardly extending from said top face of said main member, said tab having an aperture through said tab such that said aperture is for accepting a fastener through said aperture, said fastener being adapted for insertion into a vertical surface such that said main member is supported by the vertical surface;

wherein said top face of said main member is substantially planar rectangular such that said top face is adapted for setting items on when said main member is supported by the vertical surface;

wherein each of said slots has a pair of angled walls and a pair of lip portions, each of said angled walls extends upwardly from said bottom face of said main member such that said angled walls are diverging, each of said lip portions extends outwardly from a top end of said wall such that each of said lip portions extends parallel to said bottom face, each of said lip portions of said slots being for securing a container within said slot;

wherein each of said containers has base portion and an upper portion, said upper portion having a lip for engaging said lip portions of said respective slot, said upper portion having a neck extending downwardly from said lip of said upper portion such that said neck is for engaging said angled walls of said respective slot whereby said upper portion of said container is insertable within one of said slots of said main member;

wherein each of said containers has an opening extending through said upper portion into an interior space of said base portion of said respective container such that said interior space is adapted for storing items inserted into said opening of said upper portion of said respective container;

a sealing member being positionable in said opening of said respective container such that said sealing member prevents the items stored in said container from being spilled;

a secondary member orthogonally extending from said front face of said main member such that said secondary member is positioned adjacent said top face of said main member; and a plurality of secondary slots extending through said secondary member such that said slots extend perpendicular to said front face of said main member;

wherein each of said secondary slots has a pair of angled walls and a pair of lip portions, each of said angled walls extends upwardly from a bottom surface of said secondary member such that said angled walls are diverging, each of said lip portions extends outwardly form a top end of said angled walls such the each of said lip portions extends parallel to said bottom surface, each of said lip portions of said secondary slots being for securing one of a plurality of receptacles within said secondary slot;

wherein each of said receptacles has a base portion and an upper portion, said upper portion having a lip for engaging said lip portions of said respective secondary slot, said upper portion having a neck extending downwardly from said lip of said upper portion such that said neck is for engaging said angled walls of said respective secondary slot whereby said upper portion of said respective receptacle is insertable within one of said secondary slots of said secondary member;

wherein each of said receptacles has an opening extending through said upper portion into an interior space of said base portion of said respective receptacle such that said interior space is adapted for storing items inserted into said opening of said upper portion of said respective receptacle;

a backing wall downwardly extending from said bottom face of said main member such that said backing wall is positioned adjacent said back face of said main member; and a plurality of tool hooks being coupled proximate to a distal end of said backing wall such that said tool hooks are adapted for supporting tools.

* * * * *